US010151334B1

(12) United States Patent
MacIlvane

(10) Patent No.: US 10,151,334 B1
(45) Date of Patent: Dec. 11, 2018

(54) WIND BREAKER

(71) Applicant: Mark MacIlvane, Hawthorne, NY (US)

(72) Inventor: Mark MacIlvane, Hawthorne, NY (US)

( * ) Notice: Subject to any disclaimer, the term of this patent is extended or adjusted under 35 U.S.C. 154(b) by 0 days.

(21) Appl. No.: 15/370,171

(22) Filed: Dec. 6, 2016

(51) Int. Cl.

| | |
|---|---|
| ***E04H 17/08*** | (2006.01) |
| ***F15D 1/00*** | (2006.01) |
| ***E04H 17/04*** | (2006.01) |
| ***E04H 17/26*** | (2006.01) |

(52) U.S. Cl.
CPC ..... *F15D 1/0005* (2013.01); *E04H 17/04* (2013.01); *E04H 17/08* (2013.01); *E04H 17/26* (2013.01)

(58) Field of Classification Search
CPC ..... E04H 17/08; E04H 17/04
USPC ..... 160/351; 248/156
See application file for complete search history.

(56) References Cited

U.S. PATENT DOCUMENTS

| | | | | |
|---|---|---|---|---|
| 1,930,404 | A | 10/1933 | Wagner | |
| 4,576,364 | A | 3/1986 | O'Fearna | |
| 4,685,484 | A * | 8/1987 | Moneta | E04H 15/003 135/117 |
| 4,778,090 | A | 10/1988 | Facchina | |
| 4,899,498 | A | 2/1990 | Grieb | |
| 5,029,819 | A * | 7/1991 | Kane | E01F 13/028 160/24 |
| D328,529 | S | 8/1992 | Lenarczyk | |
| D344,593 | S | 2/1994 | Monfils | |
| 2005/0269046 | A1* | 12/2005 | Freeman | E04H 15/003 160/351 |
| 2010/0175731 | A1 | 7/2010 | Day | |
| 2012/0153099 | A1* | 6/2012 | Wesolik | E02D 5/801 248/156 |
| 2015/0266548 | A1* | 9/2015 | Crosby | B63B 21/26 248/508 |

* cited by examiner

*Primary Examiner* — Katherine W Mitchell
*Assistant Examiner* — Jeremy C Ramsey

(57) ABSTRACT

The wind breaker is a portable device that: 1) redirects the direction of natural outdoor air flow; and, 2) reduces the velocity of any natural outdoor air flow that is not redirected by the wind breaker. The wind breaker comprises a panel, a plurality of sleeves, and a plurality of stanchions.

1 Claim, 5 Drawing Sheets

WIND BREAKER

CROSS REFERENCES TO RELATED APPLICATIONS

Not Applicable

STATEMENT REGARDING FEDERALLY SPONSORED RESEARCH

Not Applicable

REFERENCE TO APPENDIX

Not Applicable

BACKGROUND OF THE INVENTION

Field of the Invention

The present invention relates to the field of buildings including tents and canopies, more specifically, a wind breaker.

SUMMARY OF INVENTION

The wind breaker is a portable device that: 1) redirects the direction of natural outdoor air flow; and, 2) reduces the velocity of any natural outdoor air flow that is not redirected by the wind breaker. The wind breaker comprises a panel, a plurality of sleeves, and a plurality of stanchions.

These together with additional objects, features and advantages of the wind breaker will be readily apparent to those of ordinary skill in the art upon reading the following detailed description of the presently preferred, but nonetheless illustrative, embodiments when taken in conjunction with the accompanying drawings.

In this respect, before explaining the current embodiments of the wind breaker in detail, it is to be understood that the wind breaker is not limited in its applications to the details of construction and arrangements of the components set forth in the following description or illustration. Those skilled in the art will appreciate that the concept of this disclosure may be readily utilized as a basis for the design of other structures, methods, and systems for carrying out the several purposes of the wind breaker.

It is therefore important that the claims be regarded as including such equivalent construction insofar as they do not depart from the spirit and scope of the wind breaker. It is also to be understood that the phraseology and terminology employed herein are for purposes of description and should not be regarded as limiting.

BRIEF DESCRIPTION OF DRAWINGS

The accompanying drawings, which are included to provide a further understanding of the invention are incorporated in and constitute a part of this specification, illustrate an embodiment of the invention and together with the description serve to explain the principles of the invention. They are meant to be exemplary illustrations provided to enable persons skilled in the art to practice the disclosure and are not intended to limit the scope of the appended claims.

DETAILED DESCRIPTION OF THE EMBODIMENT

Figure 1:
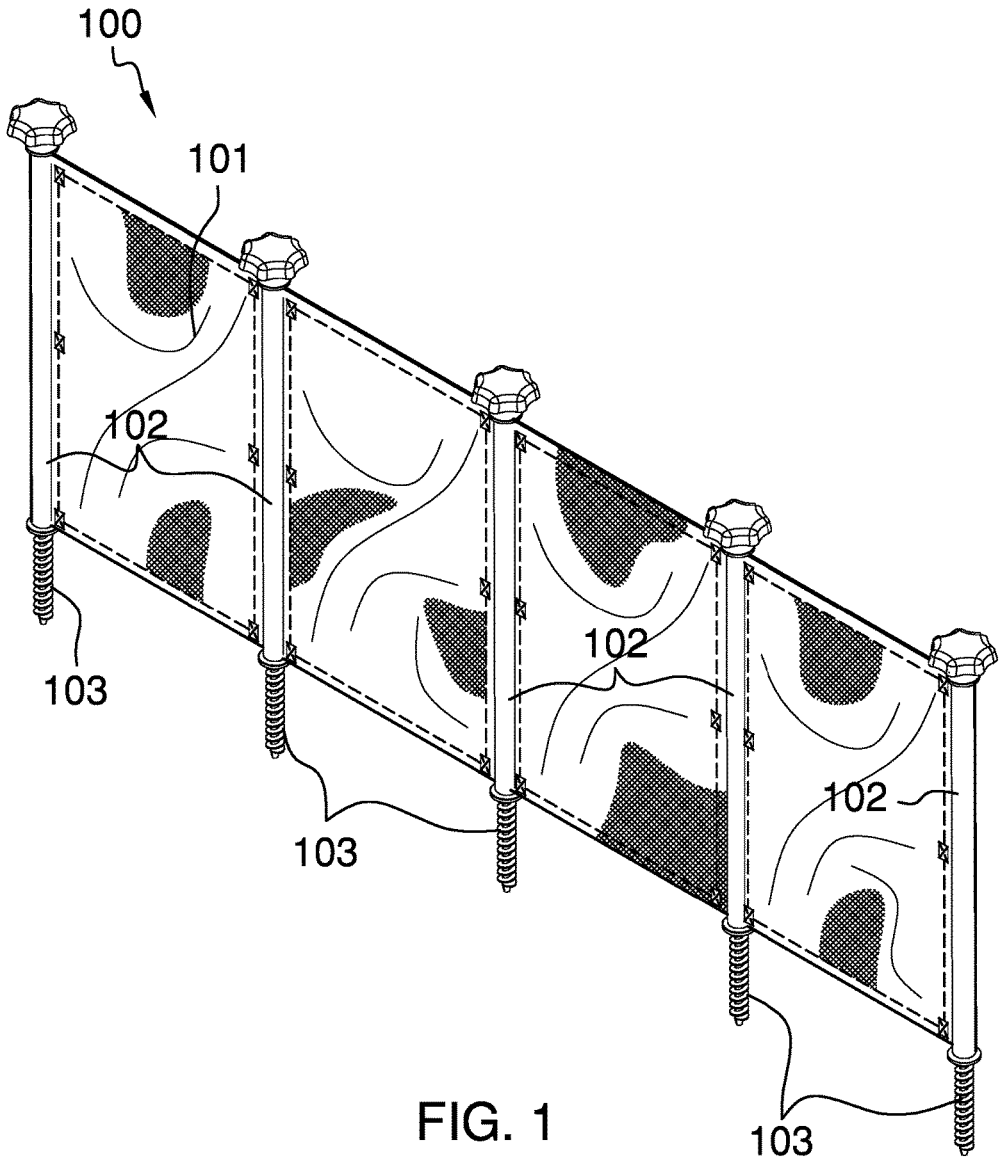
FIG. 1 is a perspective view of an embodiment of the disclosure.
Figure 2:
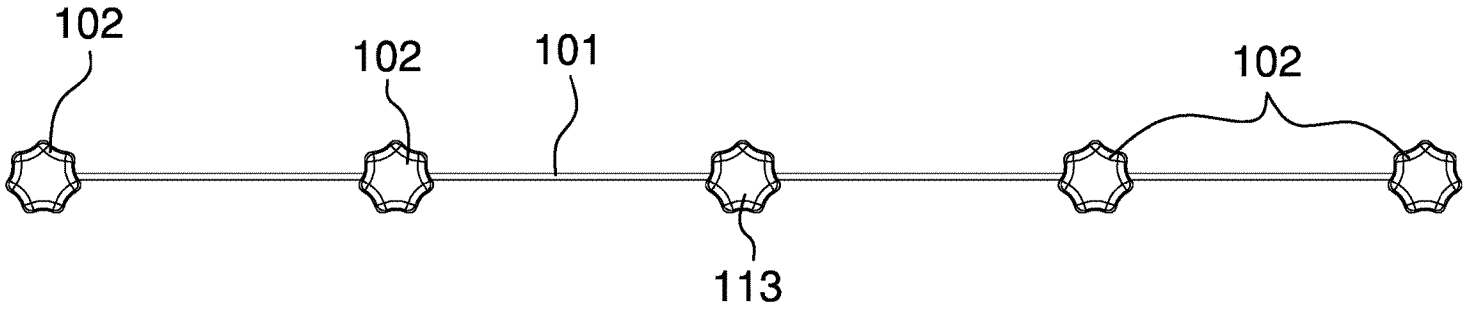
FIG. 2 is a top view of an embodiment of the disclosure.
Figure 3:
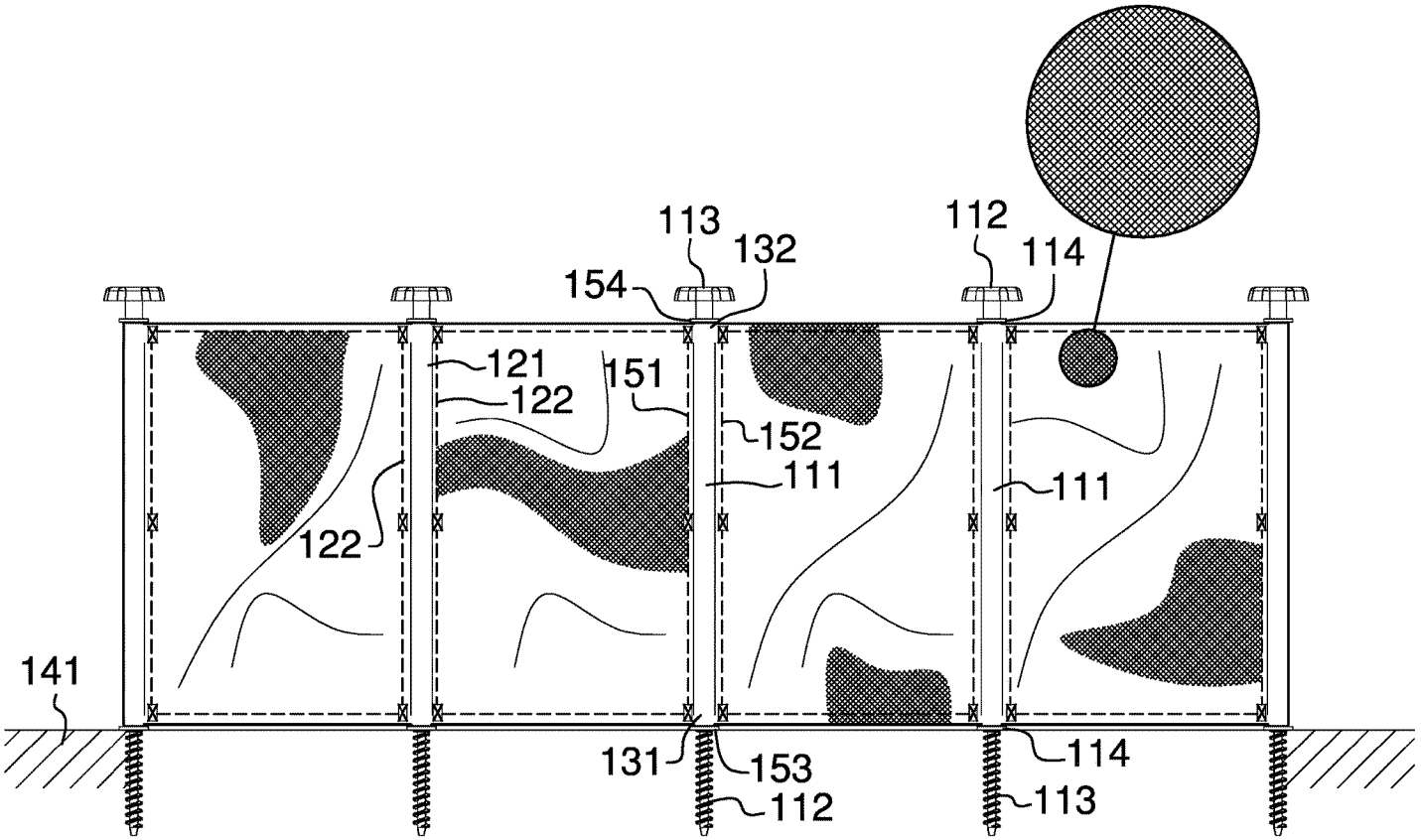
FIG. 3 is a front view of an embodiment of the disclosure.

The following detailed description is merely exemplary in nature and is not intended to limit the described embodiments of the application and uses of the described embodiments. As used herein, the word "exemplary" or "illustrative" means "serving as an example, instance, or illustration." Any implementation described herein as "exemplary" or "illustrative" is not necessarily to be construed as preferred or advantageous over other implementations. All of the implementations described below are exemplary implementations provided to enable persons skilled in the art to practice the disclosure and are not intended to limit the scope of the appended claims. Furthermore, there is no intention to be bound by any expressed or implied theory presented in the preceding technical field, background, brief summary or the following detailed description.

Detailed reference will now be made to one or more potential embodiments of the disclosure, which are illustrated in FIGS. 1 through 5.

The wind breaker 100 (hereinafter invention) is a portable breaker that: 1) redirects the direction of natural outdoor air flow; and, 2) reduces the velocity of any natural outdoor air flow that is not redirected by the invention 100. The invention 100 comprises a panel 101, a plurality of sleeves 102, and a plurality of stanchions 103. Each of the plurality of sleeves 102 are attached to the panel 101. Each of the plurality of stanchions 103 are inserted into a channel 123 formed by the attachment of a sleeve selected from the plurality of sleeves 102 to the panel 101. The invention 100 attaches to the ground 141 near the protected space such that the invention 100 is supported from the ground 141.

The panel 101 is a mesh sheeting material that is commonly referred to and marketed as "wind netting" or "wind mesh." The panel 101 is formed in the shape of a rectangular sheet. In the first potential embodiment of the disclosure, the panel 101 is formed from a flexible structure formed from a material selected from the group consisting of a textile material or a plastic material. Methods to form mesh materials are well known and documented in the mechanical and textile arts.

Each of the plurality of sleeves 102 comprises a sleeve panel 121 and a plurality of seams 122. Each of the plurality of sleeves 102 forms a channel 123. As shown most clearly in FIG. 5, the channel 123 is a tube like structure within which a stanchion selected from the plurality of stanchions 103 is inserted. As shown most clearly in FIGS. 1 and 5, the sleeve panel 121 is a sheeting material that attaches to the surface of the panel 101 to form the channel 123. Each of the plurality of seams 122 attaches the sleeve panel 121 to the panel 101. In the first potential embodiment of the disclosure, each of the plurality of seams 122 is selected from the group consisting of a sewn seam, a heat bonded seam, an ultrasonically bonded seam, or a seam formed using an adhesive.

Each of the plurality of stanchions 103 comprises a shaft 111, an auger 112, a handle 113, and a plurality of washers 114. In the first potential embodiment of the disclosure, the shaft 111 is a readily and commercially available cylindrical pipe. The outer diameter of the shaft 111 is smaller than the inner dimension of the channel 123 such that the shaft 111 can be inserted through the channel 123. The shaft 111 is further defined with a first end 131 and a second end 132. The auger 112 attaches to the first end 131 of the shaft 111 such that the center axis of the auger 112 is aligned with the center axis of the shaft 111. The auger 112 from any stanchion selected from the plurality of stanchions 103 is a commercially available device that: 1) bores a hole in the ground 141; and 2) secures the selected stanchion to the ground 141 during the use of the invention 100. The handle 113 attaches to the second end 132 of each stanchion selected from the plurality of stanchions 103. The handle 113 is a structure that allows for the rotation of the shaft 111, and by implication the auger 112, such that the auger 112 can be driven into the ground 141. In the first potential embodiment of the disclosure, the handle 113 is a disk that attaches to the second end 132 such that the line formed by the center axis of the shaft 111 runs through center of the handle 113. The plurality of washers 114 limit the range of motion of the panel 101 in the direction parallel to the center axis of the shaft 111 when the shaft 111 is installed as intended to the panel 101.

Figure 4:
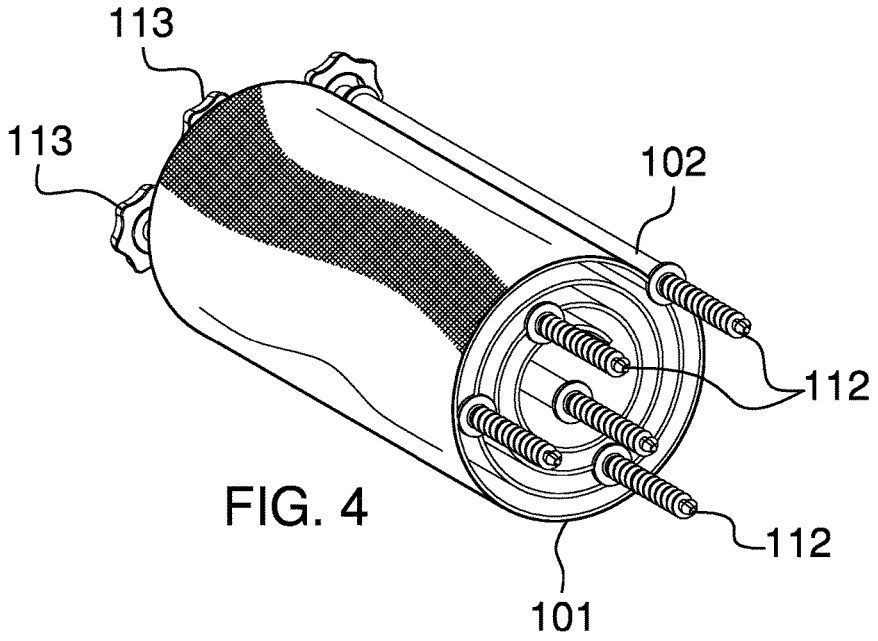
FIG. 4 is a bottom view of an embodiment of the disclosure.
Figure 5:
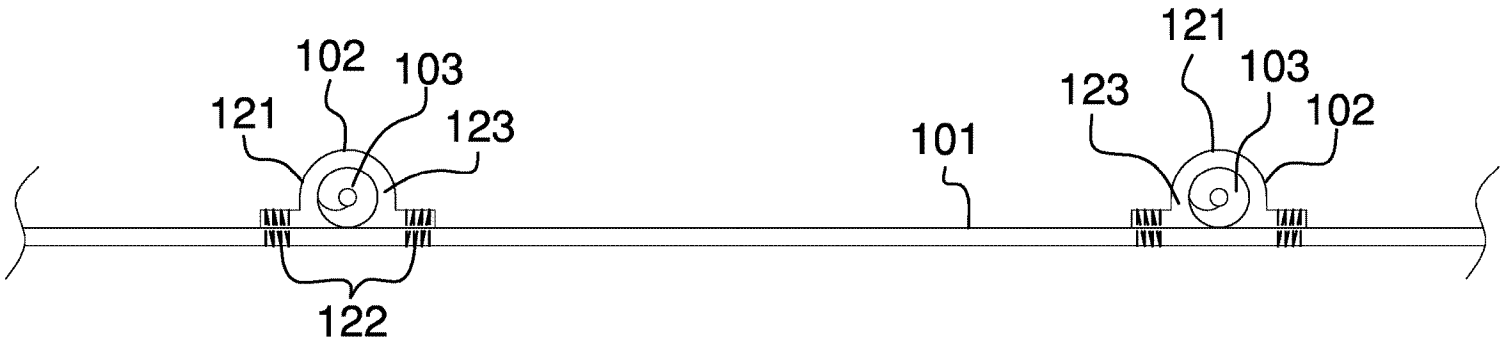
FIG. 5 is a detail view of an embodiment of the disclosure.

In the first potential embodiment of the disclosure, panel 101 is formed from a semi-rigid material that: 1) is elastic in nature; 2) is self-supporting when the invention 100 is installed for use; and 3) can be rolled, as shown most clearly in FIG. 4, for storage purposes when the invention 100 is not in use It is preferred that the sleeve panel 121 of each sleeve selected from the plurality of sleeves 102 be formed from the same material as that panel 101. In the first potential embodiment of the disclosure, the plurality of seams 122 comprises a first seam 151 and a second seam 152. The direction of the first seam 151 and the second seam 152 as installed on the panel 101 is parallel to the direction of the center axis of the shaft 111 when the shaft 111 is installed as intended to the panel 101. Each of the plurality of washers 114 further comprises a first washer 153 and a second washer 154. The first washer 153 attaches to the first end 131 of the shaft 111. The second washer 154 attaches to the second end 132 of the shaft 111. The first washer 153 and the second washer 154 limit the range of motion of the panel 101 in the direction parallel to the center axis of the shaft 111 when the shaft 111 is installed as intended to the panel 101.

The following definitions were used in this disclosure:

Auger: As used in this disclosure, an auger is a tool with a helical or screw type bit that is used for boring holes in objects.

Center: As used in this disclosure, a center is a point that is: 1) the point within a circle that is equidistant from all the points of the circumference; 2) the point within a regular polygon that is equidistant from all the vertices of the regular polygon; 3) the point on a line that is equidistant from the ends of the line; 4) the point, pivot, or axis around which something revolves; or, 5) the centroid or first moment of an area or structure. In cases where the appropriate definition or definitions are not obvious, the fifth option should be used in interpreting the specification.

Center Axis: As used in this disclosure, the center axis is the axis of a cylinder or cone like structure. When the center axes of two cylinder or like structures share the same line they are said to be aligned. When the center axes of two cylinder like structures do not share the same line they are said to be offset.

Cylinder: As used in this disclosure, a cylinder is a geometric structure defined by two identical flat and parallel ends, also commonly referred to as bases, which are circular in shape and connected with a single curved surface, referred to in this disclosure as the face. The cross section of the cylinder remains the same from one end to another. The axis of the cylinder is formed by the straight line that connects the center of each of the two identical flat and parallel ends of the cylinder. In this disclosure, the term cylinder specifically means a right cylinder which is defined as a cylinder wherein the curved surface perpendicularly intersects with the two identical flat and parallel ends.

Disk: As used in this disclosure, a disk is a cylindrically shaped object that is flat in appearance.

Handle: As used in this disclosure, a handle is an object by which a tool, object, or door is held or manipulated with the hand.

Inner Diameter: As used in this disclosure, the term inner diameter is used in the same way that a plumber would refer to the inner diameter of a pipe.

Inner Dimension: As used in this disclosure, the term inner dimension describes the span from a first inside or interior surface of a container to a second inside or interior surface of a container. The term is used in much the same way that a plumber would refer to the inner diameter of a pipe.

Outer Diameter: As used in this disclosure, the term outer diameter is used in the same way that a plumber would refer to the outer diameter of a pipe.

Outer Dimension: As used in this disclosure, the term outer dimension describes the span from a first exterior or outer surface of a tube or container to a second exterior or outer surface of a tube or container. The term is used in much the same way that a plumber would refer to the outer diameter of a pipe.

Pipe: As used in this disclosure, the term pipe is used to describe a rigid hollow cylinder. While pipes that are suitable for use in this disclosure are often used to transport or conveys fluids or gases, the purpose of the pipes in this disclosure are structural. In this disclosure, the terms inner diameter of a pipe and outer diameter are used as they would be used by those skilled in the plumbing arts.

Seam: As used in this disclosure, a seam is a joining of: 1) a first textile to a second textile; 2) a first sheeting to a second sheeting; or, 3) a first textile to a first sheeting. Potential methods to form seams include, but are not limited to, a sewn seam, a heat bonded seam, an ultrasonically bonded seam, or a seam formed using an adhesive.

Sewn Seam: As used in this disclosure, a sewn seam a method of attaching two or more layers of textile, leather, or other material through the use of a thread, a yarn, or a cord that is repeatedly inserted and looped through the two or more layers of textile, leather, or other material.

Shaft: As used in this disclosure, the term shaft is used to describe a rigid cylindrical object. The terms inner diameter of the shaft and outer diameter of the shaft are used as they would be used by those skilled in the plumbing arts. The definition of shaft explicitly includes solid shafts or shafts that are formed more like pipes with a hollow passage through the shaft that runs along the center axis of the shaft cylinder.

Sheeting: As used in this disclosure, sheeting is a material, such as a textile, a plastic, or a metal foil, in the form of a thin flexible layer or layers.

Sleeve: As used in this disclosure, a sleeve is a covering within which an object may be contained.

Stanchion: As used in this disclosure, a stanchion refers to an upright pole, post, or support.

Textile: As used in this disclosure, a textile is a material that is woven, knitted, braided or felted. Synonyms in common usage for this definition include fabric and cloth.

Wind Breaker: As used in this disclosure, a wind breaker is a structure that is used to protect a space from the effects of the natural outdoor air flow that is commonly referred to as wind. The primary function of a wind breaker is to redirect the bulk of the natural outdoor air flow around the protected space. As is typical with most fluid flow, the redirection of the natural outdoor air flow will create a flow turbulence around the protected space. To minimize the impact of this turbulent air flow, the breaker structure of the wind breaker is formed as a gas permeable structure that allows for the passage of a portion of the natural outdoor air flow through the breaker structure at a reduced flow velocity. This "leakage" reduces the severity and impact of the turbulent air flow around the protected space.

With respect to the above description, it is to be realized that the optimum dimensional relationship for the various components of the invention described above and in FIGS. 1 through 5 include variations in size, materials, shape, form, function, and manner of operation, assembly and use, are deemed readily apparent and obvious to one skilled in the art, and all equivalent relationships to those illustrated in the drawings and described in the specification are intended to be encompassed by the invention.

It shall be noted that those skilled in the art will readily recognize numerous adaptations and modifications which can be made to the various embodiments of the present invention which will result in an improved invention, yet all of which will fall within the spirit and scope of the present invention as defined in the following claims. Accordingly, the invention is to be limited only by the scope of the following claims and their equivalents.

What is claimed is:

1. A wind breaker comprising:

a panel, a plurality of sleeves, and a plurality of stanchions;

wherein each of the plurality of sleeves are attached to the panel;

wherein each of the plurality of stanchions are inserted into a respective channel formed by the attachment of a sleeve selected from the plurality of sleeves to the panel;

wherein the wind breaker is a portable wind breaker;

wherein the wind breaker redirects a direction of a portion of a natural outdoor air flow directed towards the wind breaker;

wherein the wind breaker reduces the velocity of the portion of the natural outdoor air flow directed towards the wind breaker that is not redirected by the wind breaker;

wherein the wind breaker attaches to the ground near a protected space such that the wind breaker is supported from the ground;

wherein the panel is a mesh sheeting material;

wherein the panel is formed in the shape of a rectangular sheet;

wherein the panel is a flexible structure;

wherein each of the plurality of sleeves comprises a sleeve panel and a plurality of seams;

wherein the plurality of seams attaches the sleeve panel to the panel;

wherein each of the plurality of sleeves forms a channel;

wherein the channel is a tube-shaped structure within which a stanchion selected from the plurality of stanchions is inserted;

wherein each of the plurality of stanchions comprises a shaft, an auger, a handle, and a plurality of washers;

wherein each of the plurality of washers comprises a first washer and a second washer;

wherein the auger, the handle and the plurality of washers attach to the shaft;

wherein the shaft is a cylindrical pipe;

wherein the shaft is further defined with a first end and a second end;

wherein the first washer attaches to the first end of the shaft;

wherein the second washer attaches to the second end of the shaft;

wherein an outer diameter of the shaft is smaller than the inner dimension of the channel such that the shaft can be inserted through the channel;

wherein the auger attaches to the first end of the shaft such that a center axis of the auger is aligned with a center axis of the shaft and the first washer is between the auger and the shaft;

wherein the auger from any stanchion selected from the plurality of stanchions bores a hole in the ground;

wherein the auger from any stanchion selected from the plurality of stanchions secures the selected stanchion to the ground during the use of the wind breaker;

wherein the handle attaches to the second end of each stanchion selected from the plurality of stanchions;

wherein the second washer is between the handle and the stanchion;

wherein the handle is a structure that facilitates the rotation of the shaft;

wherein the plurality of washers limit a range of motion of the panel in a direction parallel to the center axis of the shaft;

wherein the panel can be rolled;

wherein the plurality of seams comprises a first seam and a second seam;

wherein a direction of the first seam and the second seam as installed on the panel is parallel to the direction of the center axis of the shaft;

wherein the panel is formed from a material selected from the group consisting of a textile material and a plastic material;

wherein the sleeve panel is a sheeting material;

wherein each of the plurality of seams is selected from the group consisting of a sewn seam, a heat bonded seam, an ultrasonically bonded seam, and a seam formed using an adhesive;

wherein the handle is a disk that attaches to the second end such that a line formed by the center axis of the shaft runs through a center of the handle;

wherein the sleeve panel of each sleeve selected from the plurality of sleeves is formed from a same material as that panel.

* * * * *